United States Patent [19]

Sone et al.

[11] Patent Number: 4,827,180

[45] Date of Patent: May 2, 1989

[54] COLOR PICTURE TUBE WITH SUPPORT MEMBERS FOR THE MASK FRAME

[75] Inventors: Toshinao Sone, Kumagaya; Hiroshi Urata, Fukaya; Michio Nakamura, Kamisato; Tooru Takahashi, Fukaya; Hidetoshi Yamazaki, Fukaya; Kiyoshi Tokita, Fukaya, all of Japan

[73] Assignee: Kabushiki Kaisha Toshiba, Kawasaki, Japan

[21] Appl. No.: 120,982

[22] Filed: Nov. 16, 1987

[30] Foreign Application Priority Data

Nov. 20, 1986 [JP] Japan ..... 61-275128
Apr. 23, 1987 [JP] Japan ..... 62-98644

[51] Int. Cl.[4] ..... H01J 29/07

[52] U.S. Cl. ..... 313/404; 313/406; 313/407

[58] Field of Search ..... 313/404, 406, 407

[56] References Cited

U.S. PATENT DOCUMENTS 4,652,792 3/1987 Tokita et al. ..... 313/404
4,659,958 4/1987 D'Amato ..... 313/405
4,723,088 2/1988 Sone et al. ..... 313/404

FOREIGN PATENT DOCUMENTS 46-19499 6/1971 Japan ..... 313/406
58-144 1/1983 Japan .
1189403 4/1970 United Kingdom ..... 313/406
2097996 11/1982 United Kingdom .

*Primary Examiner*—Leo H. Boudreau
*Assistant Examiner*—K. Wieder
*Attorney, Agent, or Firm*—Oblon, Fisher, Spivak, McClelland & Maier

[57] ABSTRACT

A color picture tube having a shadow mask structure with a shadow mask and a mask frame supporting the shadow mask facing a phosphor screen inside a panel comprises a plurality of V-shaped support members, each having a folded portion apart from a sidewall of the mask frame and two arm portions extending from the folded portion.

The support members support the shadow mask structure to the panel to control a relative distance beween the phosphor screen and the shadow mask according to thermal expansion of the shadow mask structure or the panel, whereby positions impinged by an electron beam on the phosphor screen remained invariably.

13 Claims, 9 Drawing Sheets

COLOR PICTURE TUBE WITH SUPPORT MEMBERS FOR THE MASK FRAME

BACKGROUND OF THE INVENTION

1. Field of the Invention

This invention relates to a color picture tube, with support members for the mask frame and more particularly to a color picture tube with a shadow mask structure comprising a shadow mask and a mask frame suspended at the diagonal portions of an envelope panel.

2. Description Of the prior Art

In general, a shadow mask structure of a color picture tube is suspended by support members to be engaged with stud pins implanted at the diagonal corner portions of inner sidewalls of the panel.

For example. U.K. Patent No. 1,189,403 discloses a shadow mask structure suspended through four support members on the four corners of the substantially rectangular panel. There are several advantages to this type structure. First, since the substantially rectangular mask frame is suspended by its four corners, the influence of deformations of the mask frame is smaller in comparison with a structure in which the mask frame is suspended by the center portions of the panel side. This can reduce electron beam misregister on phosphor elements of an associated phosphor screen. Second, for the same reason, electron beam landing misregister caused by vibration can be reduced. Thirdly, so-called long-term color purity drift phenomena which occur 30 minutes or more after initial tube operation, can be corrected without the use of bimetal that has been commonly used. The principle of this correction will be described with reference to FIG. 17.

In FIG. 17, a support member 25 is secured to the sidewall of a mask frame 20. For convenience of manufacturing, a plate 2 is often interposed between support member 25 and mask frame 20 for welding to mask frame 20. When an aperture 22 formed by thermal expansion on the shadow mask 23 shifts toward the periphery (from the dashed line to the solid line) to a position 24 as indicated by the arrow, support member 25 having an angle $\theta$ with respect to a tube axis parallel line 26 functions so as to move aperture 22 toward the phosphor screen to a position 27. Thus, the path of the electron beam 28 does not change and electron beam landing misregister does not occur. For this purpose, the angle $\theta$ is usually selected at a substantially right angle to the path of an electron beam 28 reaching the screen corner. For example, in the case of a 90-degree deflection tube, the angle $\theta$ is approximately 45°.

An angle $\theta$ of a 110-degree deflection tube, may be selected appropriately at 35°. However, as shown in FIG. 17, in order to install the shadow mask structure properly on a panel 29, it is necessary to leave a space S between the extended portion 25*a* of support member 25 and the sidewall 20*a* of frame 20. When the angle $\theta$ is smaller, an inclined section 30 of support member 25 has to be longer. As a result, the resistance of the structure to mechanical impact is reduced. An increase of the angle $\theta$ leads the excessive correction of the purity drift.

Recently a color picture tube with a shadow mask having a small thermal expansion coefficient, such as invar , i.e., a 36% Ni-Fe alloy having a thermal expansion coefficient of approximately $1.2\times10^{-6}$/°C., and a mask frame of iron has been developed. The use of the above-described support member, however, results in the occurrence of electron beam landing misregister.

The reason can be explained as follows. When a temperature rise within the tube occurs, expansion of the shadow mask 23 effectively is avoided. Thus, the aperture 22 does not shift as shown in FIG. 18. On the other hand, the mask frame 20 is made of iron having a thermal expansion coefficient of approximately 10 times that of 36% Ni-Fe alloy (i.e., approximately $1.2\times10^{-5}$° C. at room temperature). Thus, the mask frame 20 exhibits thermal expansion. As a result, the support member 25 causes the shadow mask 23 to move toward the phosphor screen 31, as shown by the solid line in FIG. 18. The aperture 22 is moved to a position 24. Consequently, the path of the electron beam passing through the aperture changes from the position 28 to the position 32, and the electron beam becomes misregistered. If the shadow mask 23 and the mask frame 20 each is made of a material having a small thermal expansion coefficient, such as invar, and the thermal expansion of the panel 29 has no expansion, such problems can be avoided. However, this causes a significant increase in the manufacturing costs, and is not suitable for practical use.

As described above, when the conventional support members are used, electron beam landing misregister occurs. Consequently, long-term color purity drift, and mechanical weakness result.

SUMMARY OF THE INVENTION

Accordingly, one object of the present invention is to provide a color picture tube which avoids the long-term color purity drift phenomena and has a shadow mask structure which is easy to install.

Briefly, in accordance with one aspect of the present invention, a color picture tube comprises an evacuated envelope including a panel having a phosphor screen thereon, a shadow mask structure including a shadow mask and a mask frame attached to the mask, and means for supporting the shadow mask structure in the envelope opposite to the phosphor screen, including a plurality of support members, each having a first arm portion attached to the envelope, and a second arm portion including a fastening section fixed to the frame and an angled section extending away from the frame, the first arm portion being connected to the angled section of the second arm portion.

There is a folded portion at a position where the first and second arm portions are connected with each other.

The first arm portion also has a connection section extending from the folded portion at a first predetermined angle with respect to a parallel line in parallel with the tube axis of the evacuated envelope and an attachment section engaged with a stud pin inplanted the panel.

The second arm portion has the angled section extending from the folded portion at a second predetermined angle with respect to the parallel line and the fastening section fixed to the sidewall of the mask frame.

The support member can also be formed by one member which is bent into substantially V-shape, one side of which is engaged with the stud pin and the other of which is rigidly secured to the sidewall of the mask frame. The shadow mask and the mask frame also can be formed integrally. A thermal expansion coefficient of the shadow mask can be smaller than that of the mask frame. The first predetermined angle $\theta_1$, formed between a parallel line that passes through the folded portion of the support member in parallel with the tube axis and a plane of the connection section of the first arm portion, can be different from the second predetermined angle $\theta_2$ formed between the parallel line and a plane of the angled section of the second arm portion.

In accordance with another aspect of the present invention, a color picture tube contains support members. Each of the support members comprises a folded portion, a first arm portion extending from the folded portion toward the stud pin having a first predetermined angle with respect to the tube axis, and a second arm portion extending from the folded portion toward the shadow mask having a second predetermined angle. Each of support members is designed to satisfy the following relationship:

$$\frac{\tan\theta_1}{K_1} < \frac{\tan\theta_2}{K_2}$$

where $K_1$ (Kg f/mm) is a spring constant of the first member, $K_2$ (Kg f/mm) is a spring constant of the second member. $\theta_1$ is the first predetermined angle, and $\theta_2$ is the second predetermined angle.

In accordance with another aspect of the present invention, there is provided a color picture tube such that even when a mask frame is expanded by thermal expansion &toward the periphery, the mask frame is not caused to move toward the phosphor screen, or at least the movement thereof can reduce below a desired minimum value, whereby occurrence of the above-described long-time color purity drift which is an erroneous correction can be avoided.

More specifically, the mechanism of correction of the long-term color purity drift as to the support member can be expressed as follows.

As shown in FIG. 10, during the tube operation, a distance S between the first arm portion 62 and the second arm portion 67 decreases, however, the amount of the decrease is determined by the spring constants of the first and second arm portions.

Namely, when the amount of change of the space S is defined as $\Delta S$, the amount of change of the first arm portion as $\Delta S_1$, and the amount of change of the second arm portion as $\Delta S_2$, respectively, the relationship between $\Delta S_1$ and $\Delta S_2$ can be expressed as follows:

$$\Delta S_1 = \frac{K_2}{K_1 + K_2}\Delta S,\ \Delta S_2 = \frac{K_1}{K_2 + K_1}\Delta S$$

Here, the amount of movement of the mask frame structure caused by the support member 60 toward the tube axial direction is defined as $\Delta q$, and holds the following relationship, $$\Delta q = \Delta S_1 \tan\theta_1 - \Delta S_2 \tan\theta_2.$$

Now, if the resultant spring constant of $K_1$ and $K_2$ is defined as K, $$K = \frac{K_1 K_2}{K_1 + K_2}$$

using this, the above-described equation will be $$\Delta q = \left(\frac{\tan\theta_1}{K_1} - \frac{\tan\theta_2}{K_2}\right) \cdot K\Delta S. \quad (1)$$

Here, $\Delta q$ is defined to be positive value when the mask frame structure moves closer to the screen. On the other hand, $\Delta q$ is defined to be negative value when the mask frame structure moves away from the screen. This movement is required to correct the long-term color purity drift under the condition such that the color picture tube has been incorporated in the TV receiver. In other words, so long as the equation (1) is satisfied, the folded portion between the first and second arm portions to be rigidly secured may be determined at any positions between the mask frame side and the stud pin. Thus, the installing operations of the shadow mask can be significantly improved.

DESCRIPTION OF THE PREFERRED EMBODIMENTS

Figure 1:
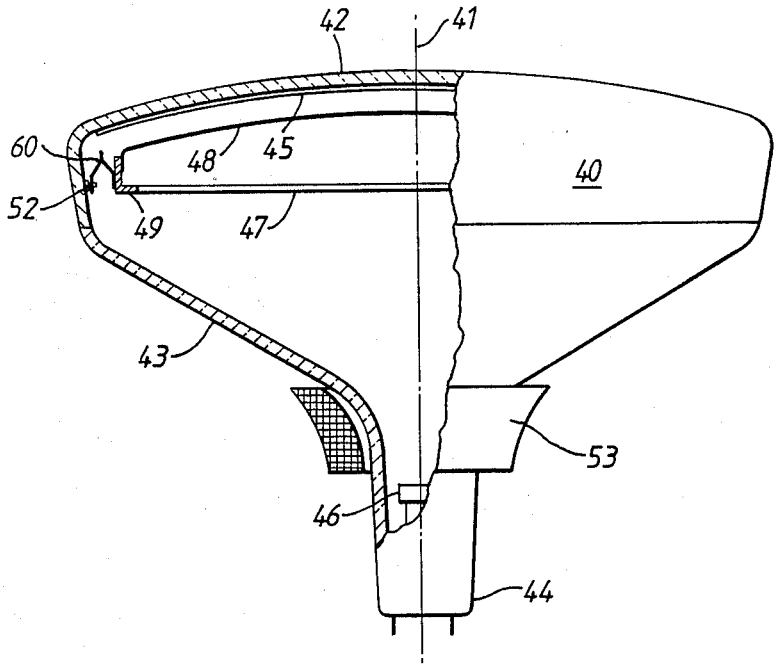
FIG. 1 is a partially cutaway sectional view illustrating one embodiment according to the present invention.
Figure 2:
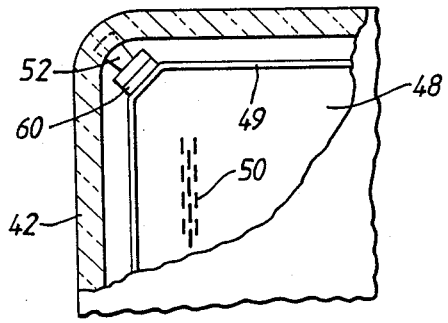
FIG. 2 is a partially cut away plan view of the embodiment of FIG. 1.

Referring now to the drawings, wherein like reference numerals designate identical or corresponding parts throughout the several views, one embodiment according to the present invention will be described. In FIGS. 1 and 2, an evacuated envelope 40 with a tube axis 41 comprises a rectangular shaped panel portion 42, a funnel portion 43 connected and sealed to panel portion 42 and a neck portion 44 projecting from funnel portion 43, the tube axis 41 passing through a& the center thereof. On the inner surface of the panel portion 42, there is deposited a phosphor screen 45 containing stripe shaped phosphor layers that respectively emit light of red, green and blue. Within the neck 44, a so-called in-line type electron gun 46 is mounted. Gun 46 generates three electron beams aligned along the horizontal axis of the panel portion 42 and corresponding to respective color elements of red, green and blue.

A shadow mask structure 47 comprises a rectangular shaped shadow mask 48 and a mask frame 49. Shadow mask 48 is rigidly supported by mask frame 49 at a position opposite to phosphor screen 45 so that the tube axis 41 perpendicularly passes therethrough. Shadow mask 48 has a large number of slit-shaped apertures 50 extended in a vertical direction. Mask frame 49 is engaged through support members 60 with stud pins 52 implanted in the inner sidewall of the panel portion 42 at four corners facing diagonally, to be supported inside panel portion 42.

Three in-line arranged electron beams generated by gun 46 are deflected by a deflection apparatus 53 outside the funnel 43 so as to scan a rectangular area corresponding to the rectangular panel portion 42, and to land on the stripe-shaped phosphor layers after passing through the apertures 50 of the shadow mask 48. The mask 48 performs color selection so that color picture images can be reproduced.

Next, the engaging portion of shadow mask structure 47 will be described in detail with reference to FIG. 3. Shadow mask 48 of a 36% Ni-Fe alloy having a small thermal expansion coefficient, i.e., invar, is Secured rigidly at the periphery by welding to the inner sidewall of iron mask frame. The support member 60 comprises a folded portion 61, a first arm portion 62 and a second arm portion 67, both arm portions connected by folded portion 61. First arm portion 62 comprises an connection section 63 and an attachment section 64 extending from connection section 63, having an inclination with respect to a tube axis parallel line 54 in parallel with the tube axis 41. Attachment section 64 has a hole 65 engaged with stud pin 52. Second arm portion 67 comprises an angled section 68 having an inclination with respect to the tube axis parallel line 54 and a fastening section 69 extending from angled section 68. Fastening section 69 is fixed by welding to the sidewall 55 of mask frame 49. First and second arm portions 62 and 67 are welded at folded portion 61, so as to form a substantially V-shaped cross-section as viewed along the tube axis. Folded portion 61 is positioned at a substantially halfway point between sidewall 55 of mask frame 49 and stud pin 52 so as to extend away from sidewall 55. Here, an angle $\theta_1$ is formed between parallel line 54 that passes through folded portion 61 in parallel with tube axis 41 and connection section 63 of first arm portion 62. An angle $\theta_2$ is also formed between parallel line 54 and angled section 68 of the second member 67. Both angles are substantially equal with each other.

Both first and second arm portions 62 and 67 are made of stainless steel for example, SUS 631) superior in spring properties, with a thickness of approximately 0.35 to 0.6 mm.

Figure 4:
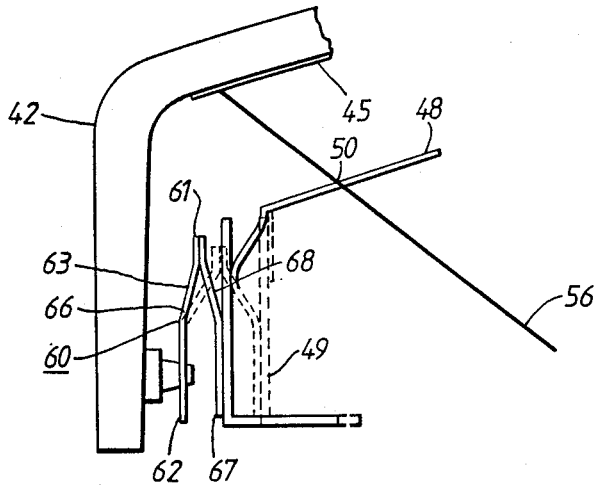
FIG. 4 is a sectional view for explaining operations of one embodiment shown in FIG. 2.

Next, in FIG. 4, the shift of the shadow mask structure will be described, when the tube operates and the temperatures of the parts therein are raised. The positions of the parts-in-tube before the tube operation are shown by the dashed lines. However when the temperatures are raised, the respective positions of the parts change to the positions shown by the solid line. While the shadow mask 48 exhibits substantially no thermal expansion, the mask frame 49 expands toward the periphery because of thermal expansion. In this case, the V-shaped support member 60 is pushed such that the first arm portion 62 and the second arm portion 67 become closer to each other. However, because of $\theta_1=\theta_2$, the connection section 63 of first arm portion 62 is deformed by the amount by which support member 60 is pushed outwardly by the thermal expansion of the mask frame 49. Using a bent portion 66 as a fulcrum, support member gets closer to the inside wall of the panel portion 42 (from the shape shown by the dashed line to the shape shown by the solid line). The angled section 68 of the second arm portion 67 is also deformed using the folded portion 61 as a fulcrum, so as to straighten. Namely, first and second arm portions 62 and 67 are both deformed to a flat plate, and this deformation absorbs the expansion of the mask frame 49. Consequently, mask frame 49 does not move toward the phosphor screen 45. Therefore, the position of aperture 50 is not changed. Electron beam 56 correctly lands on the aimed phosphor element.

Figure 5:
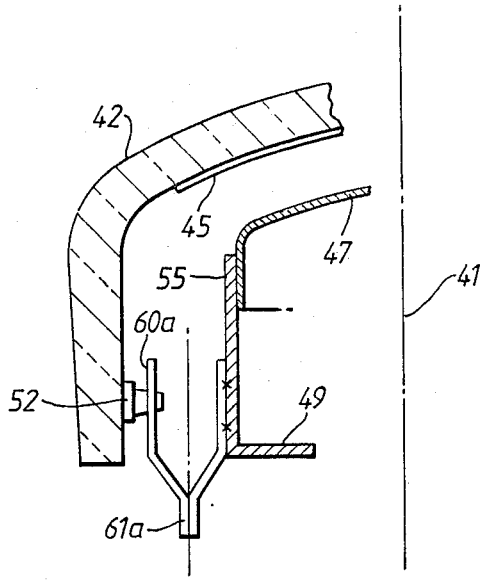
FIG. 5 is a sectional view illustrating a modification according to the present invention.

Naturally, as shown in FIG. 5, even when the folded portion 61*a* of a support member 60*a* is positioned at a position further away from the phosphor screen 45 than the stud pin 52, it is obvious that similar advantages can be obtained.

Figure 17:
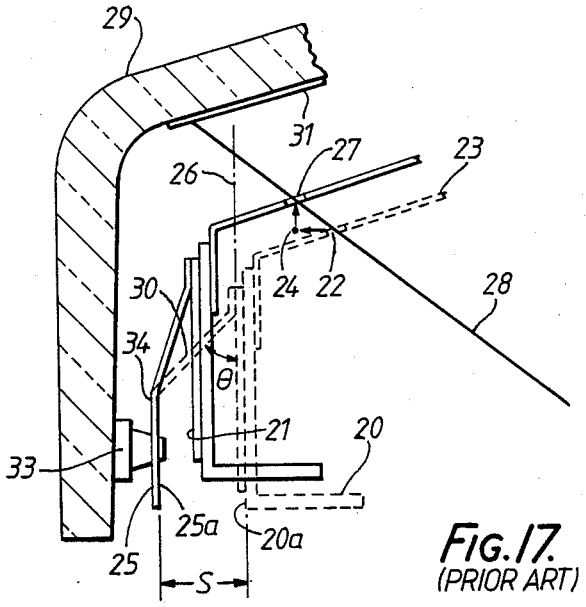
FIG. 17. (PRIOR ART)
FIG. 17 is a sectional view for explaining a conventional apparatus.
Figure 18:
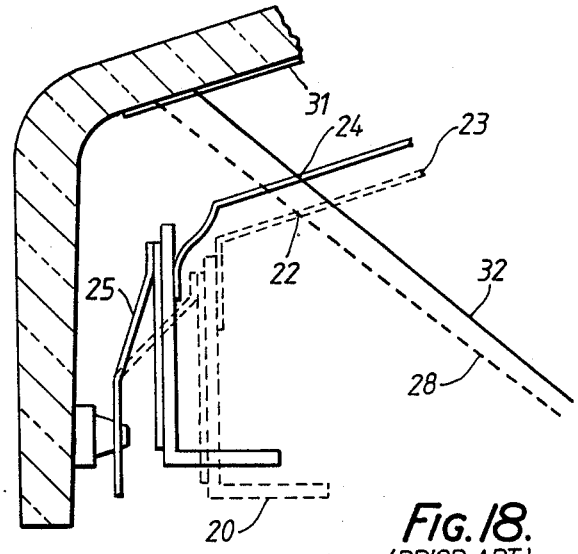
FIG. 18. (PRIOR ART)
FIG. 18 is a sectional view for explaining another conventional apparatus.

Here, in the case of a conventional support member shown in FIG. 17, the measured amount of electron beam landing misregister was 40 μm at the screen corner. However, in the case of the support member according to the embodiment of the invention in FIG. 3, it was observed that the amount of such misregister was reduced to a value of less than 5 μm. In the conventional structure as shown in FIG. 17, the side of the support member 25 facing stud pin 33 is pushed by the thermal expansion of the mask frame 20 so as to be deformed using the bent portion 34 as a fulcrum (as shown, from the dashed line to the solid line). As a result, the mask frame 20 is pushed upwardly in the drawing toward the phosphor screen 31 side. However, the plate 21 of mask frame 20 of the support member 25 is substantially flat, so that plate 21 can not deform by itself. Thus, the support member 25 can not move the mask frame 20 sufficiently. The abovementioned measurements were obtained from a 28-inch color picture tube with an anode voltage of 25 kV and an anode current of 1,400 μA, and in the lapse of 90 minutes after initial tube operation.

Figure 6:
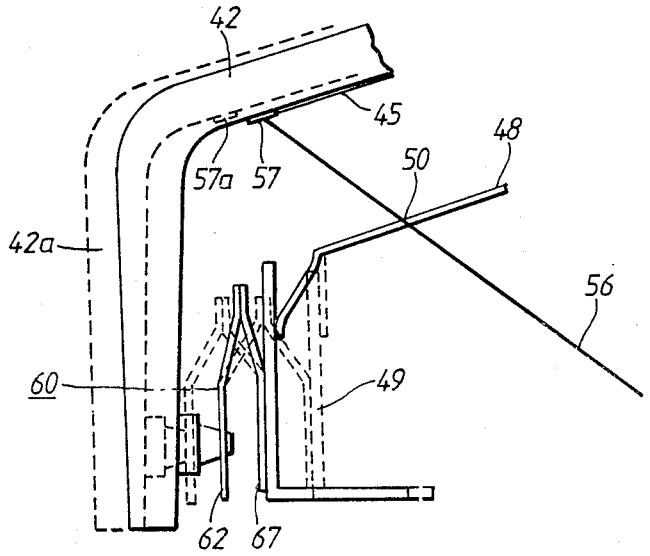
FIG. 6 is a sectional view for explaining other operations of one embodiment according to the present invention.

Recently, in order to enhance the image definition, color picture tubes have been frequently used with horizontal deflection frequencies as high as 31.5 kHz or even up to 64 kHz, twice or four times the conventional frequency. Such an increase of horizontal deflection frequencies causes an increase of iron loss and copper loss within the deflection apparatus, which in turn generates more heat. Thus, the temperature within the color TV receiver is sometimes raised by 20° C. or more above room temperature. The temperature rise is also conducted to the envelope of the color picture tube, and the panel portion 42 having the phosphor screen 45 expands at a position 42*a*, as shown in FIG. 6. Therefore, the phosphor layer 57 of the phosphor screen 45 also shifts outwardly and is positioned at 57a. As a result, phenomena similar to the excessive correction of the support member 60 develop.

Figure 7:
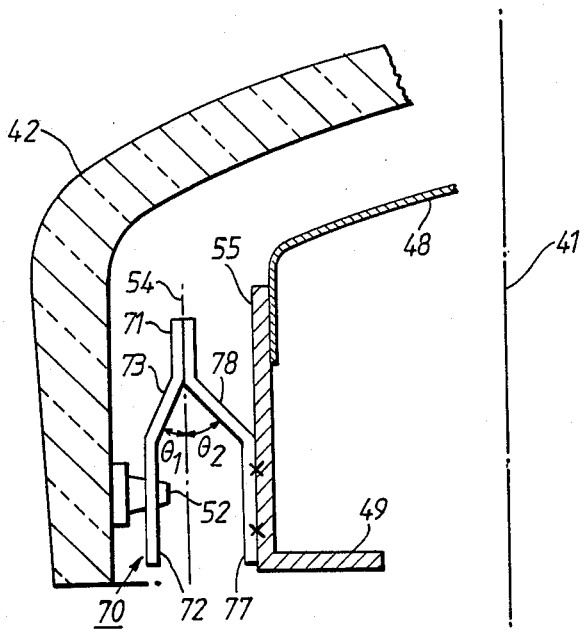
FIG. 7 is a sectional view for explaining operations of another embodiment according to the present invention.
Figure 8:
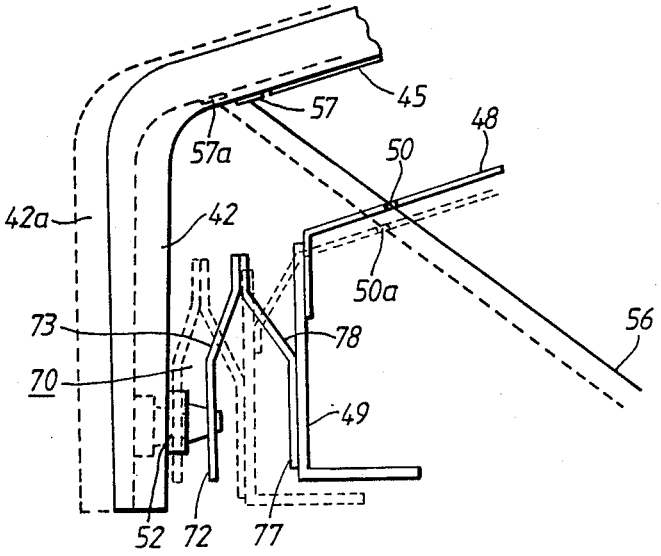
FIG. 8 is a sectional view for explaining operations of another embodiment according to the present invention.

It is recognized that the support member according to the present invention can effectively work to reduce these disadvantages. Namely, as shown in FIG. 7, a support member 70 comprises a folded portion 71, a first arm portion 72 and a second arm portion 77. An angle $\theta_1$ is formed between a parallel line 54 passing through a folded portion 71, in parallel with the tube axis 77 and a plane of a connection section 73 of firs& arm portion 72. An angle $\theta_2$ is formed between the parallel line 74 and the plane of an angled section 78 of second arm member 77. The angle $\theta_1$ is smaller than an angle $\theta_2$. As shown in FIGS. 7 and 8, second arm portion 77 has a greater angle $\theta_2$ and a longer angled section 78 than the angle $\theta_1$ end connection section 73 of first arm portion 72. Consequently, the supporting member 70 generates a force shifting the mask frame 49 in the opposite direction of the phosphor screen 45. As a result, the aperture 50 of the shadow mask 48 can be arranged to be at the position 50a away from the phosphor screen 45 such that the electron beam 56 can impinge on the phosphor element 57a which was shifted outwardly by the thermal expansion of the panel portion 42.

In general, even when a mask frame is made of a material such as a 42% Ni-Fe alloy having a thermal expansion coefficient of approximately $5\times10^{-6}$/°C. at room temperature, i.e.. approximately half the value of iron, the difference between thermal expansion coefficients of the shadow mask and the mask frame cannot be completely neglected. In this case, the shadow mask should be slightly shifted to the phosphor screen side taking the thermal expansion of the mask frame into consideration. However, the amount of the shift may be much smaller than that in the case of the mask frame made of iron. In such a case, the folded portion 81 should be positioned at a half-way point between the center of a support member 80 and the mask frame sidewall 55, as shown in FIG. 9.

Figure 9:
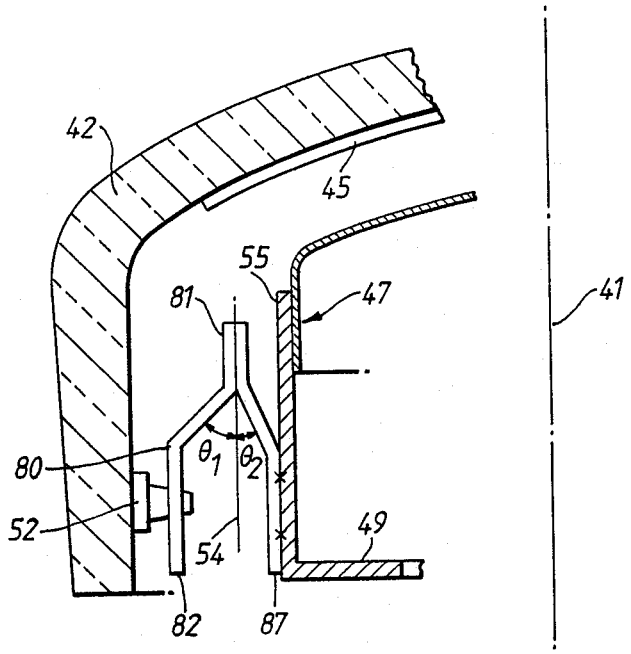
FIG. 9 is a sectional view illustrating another embodiment according to the present invention.
Figure 10:
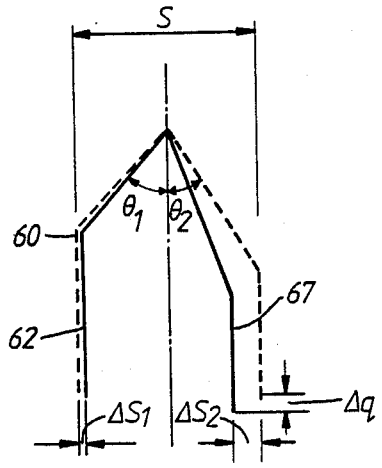
FIG. 10 is a schematic view for explaining operations of still another embodiment acoording to the present invention.

Namely, in FIG. 9, a position which is at an equidistance from both a first arm portion 82 and a second arm portion 87 should be determined as the center of the support member 80, and the folded portion 80 of the support member 80 should be so arranged as to reach the halfway point between this center and the mask frame sidewall 55, so that an angle $\theta_1$ of the first arm portion 82 can be determined to be greater than an angle $\theta_2$ of the second arm portion 87. In accordance with this arrangement, the shifting amount caused by the first arm portion 82 becomes dominant, so that the shadow mask structure 47 can be slightly shifted toward the side of phosphor screen 45.

Figure 11:
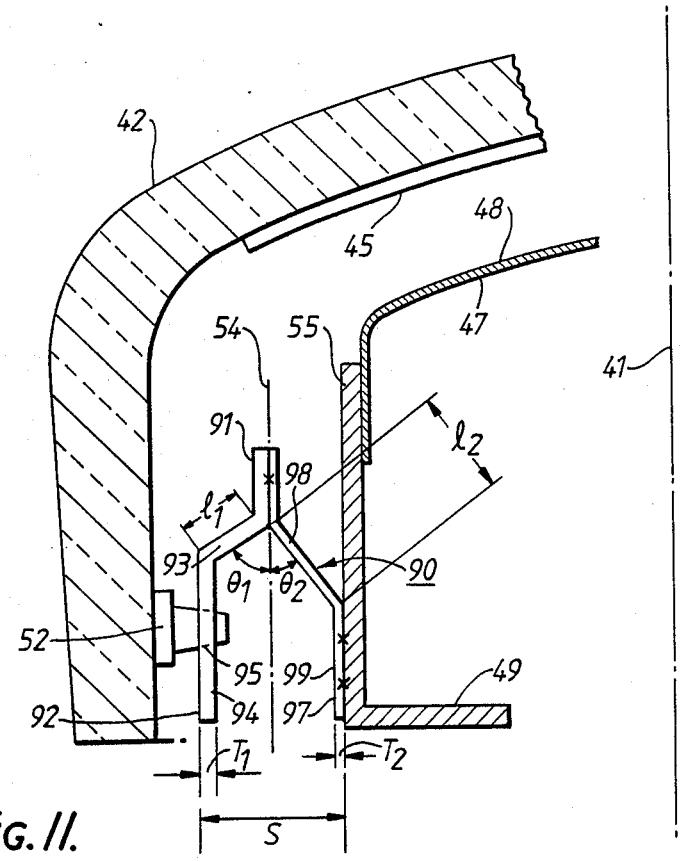
FIG. 11 is a sectional view illustrating still another embodiment according to the present invention.

Another embodiment according to the present invention will be described with reference to FIG. 11. In FIG. 11, a mask frame 49 is made of iron and a shadow mask 48 is 36% Ni-Fe alloy. A support member 90 comprises a first arm portion 92 and a second arm portion 97 welded with each other at a folded portion 91 to form a V-shape. Folded portion 92 is positioned a& a substantially halfway point between the mask frame sidewall 55 and a stud pin 52.

Second arm portion 97 is secured by welding to the mask frame 49 at plural portions thereof. Such welded positions are indicated by x marks. Both first and second arm portions 92 and 97 are made of stainless steel, e.g., SUS 631, superior in spring properties. First arm portion 92 has a thickness $T_1$ of 0.6 mm, and the second arm portion 97 has a thickness $T_2$ of 0.4 mm, respectively. First arm portion 92 is provided with a hole 95, which receives the stud pin 52 so as to suspend the shadow mask structure 47. The thickness $T_1$ of first arm portion 92 is greater than the thickness $T_2$ of second arm portion 97, i.e., $T_1$ is 1.5 times $T_2$. An angle $\theta_1$ formed between the tube axis parallel line 54 and a connection section 93 of first arm portion 92 is arranged to be approximately 40°. An angle $\theta_2$ formed between the parallel line 54 and an angled section 98 of second arm portion 97 is approximately 20°.

The space S between an attachment section 94 of first arm portion 92 which is in parallel with the tube axis 41, and a fastening section 99 of second arm portion 97 which is in parallel with the tube axis 41, is approximately 10 mm.

In this case, the length $l_1$ of connection section 93 of first arm portion 92 is arranged to be approximately 7.8 mm, and the length $l_2$ of angled section 98 of second arm portion 97 approximately 14.6 mm. The length $l_2$ is approximately two times longer than the length $l_1$. The width of first arm portion 92 is 17.2 mm and the width of second arm portion 97 is 23.0 mm. $K_1$ is approximately 4.0 Kgf/mm and $K_2$ is approximately 2.5 Kgf/mm.

Figure 12:
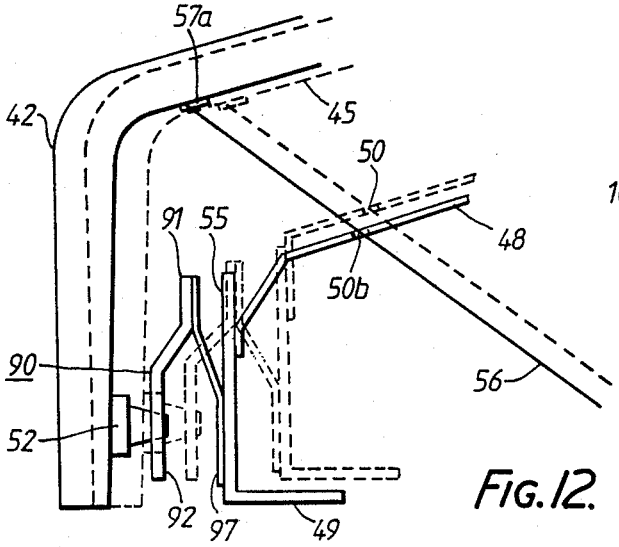
FIG. 12 is a sectional view for explaining operations of still another embodiment shown in FIG. 11.

When a color picture tube is incorporated in a TV receiver and operated for a long time, the temperatures of parts-in-tube are raised. The changes in positions of the parts before and after the operation will be described according to FIGS. 11 and 12. The dashed lines represent the positions of the parts before the operation, and when the temperatures are raised, the parts shift to the positions shown by the solid lines.

A shadow mask 48 exhibits almost no thermal expansion, however, the mask frame 49 and the panel portion 42 extend toward the periphery. Because the mask frame 49 has a greater thermal expansion coefficient and reaches a higher temperature as compared to the shadow mask 48, the distance between the mask frame sidewall 55 and the stud pin 52 are reduced.

Here, a support member 90 is deformed. However, in terms of movements in a direction perpendicular to the tube axis, the second arm portion 97 moves by an amount greater than the movement of the first arm portion 92. This is the reason why the second arm portion 97 has a smaller spring constant $K_2$ than that of the first arm portion 92. Therefore, the movement of the second arm portion 97 accounts for 96% of all movements, and the movement of the angle $\theta_2$ dominant over the angle $\theta_1$. Consequently, the mask frame structure to moves away from the phosphor screen 45.

As a result, the aperture 50 of the shadow mask 48 can be arranged to be at a position 50b away from the phosphor screen 45 such that an electron beam 56 can impinge on the phosphor 57a which was moved outwardly by the expansion of the panel portion 42.

On the other hand, also in terms of the readiness of mask installing operations, there is obviously no problem because the folded portion 91 can be located at a substantially halfway point between the mask frame sidewall 55 and the stud pin 52.

Here, actual measurement will be disclosed such that by the use of the V-shaped support member according to the embodiment of the present invention, the amount of electron beam landing misregister was reduced to 10 μm or less at the screen corner while in the case of the prior art, this has been approximately 30 μm. The value was obtained from a 28-inch color picture tube incorporated into a TV receiver with an anode voltage of 30 kV and an anode current of 1,450 μA after a 6-hour continuous operation.

The present invention is not limited to the above-described embodiments, but other optimum support members can be obtained by the use of various modifications in thickness, angles and oblique side lengths such as $T_1$ and $T_2$, $\theta_1$ and $\theta_2$, and $l_1$ and $l_2$. This is because the functions of the support members are varied depending upon the sizes of color picture tubes, heat conduction status of inside temperatures, and the materials of the support members.

Figure 13:
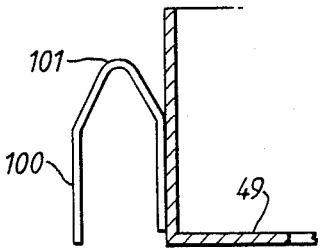
FIG. 13 is a sectional view illustrating another modification according to the present invention.

Another embodiment is shown in FIG. 13. As seen, a support member 100 can also be made of a single material bent into a V-shape. In this case, a folded portion 101 also extends at a point separated slightly from the mask frame sidewall. The support member made by only bending is somewhat inferior in mechanical strength to the two-plate welded type, and is suitable for smaller picture tubes having smaller mass of the parts-in-tube, i.e., a shadow mask structure and shield.

Furthermore, in the abovementioned embodiments, the shadow mask and the mask frame are made of materials of different kinds, however, the present invention is not limited to this, but also can be such that the mask frame is a portion of the shadow mask, namely the mask frame and the shadow mask may be formed integrally, and the support member according to the present invention is secured directly to the shadow mask.

Figure 14:
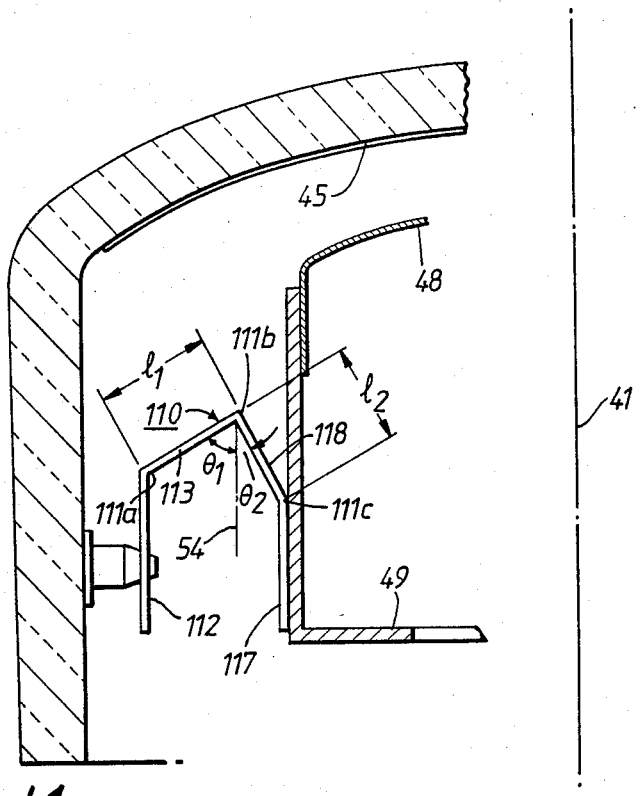
FIG. 14 is a sectional view explaining another embodiment of the present invention.

In FIG. 14, another embodiment of the invention will be described. A support member 110 supports a shadow mask structure with a shadow mask 48 and a mask frame 49 each made of iron. Support member 110 comprised a thin stainless steel plate folded at a first, second and third portions 111*a*, 111*b* and 111*c* inwardly. A first arm portion 112 is divided from a second arm portion 117 at the folded portion 111*b*. . A line 54 in parallel with the tube axis 41 passes through the folded portion 111*b*. An angle $\theta_1$ between the line 54 and a connection section 113 of first arm portion 112 is selected to 60°. An angle $\theta_2$ between the line 54 and an angled section 118 of second arm portion 117 is selected to 30°. During the tube operation, the support member 110 can move the shadow mask structure towards the phosphor screen 45 in accordance with thermal expansion, as a result, electron beam misregister is compensated. The total length $(l_1+l_2)$ of the connection section 113 and the angled section 118 also can be shorter than the length of the conventional straight inclined portion 30 in FIG. 17. Therefore, the support member mechanically Strengthened can be obtained.

Figure 15:
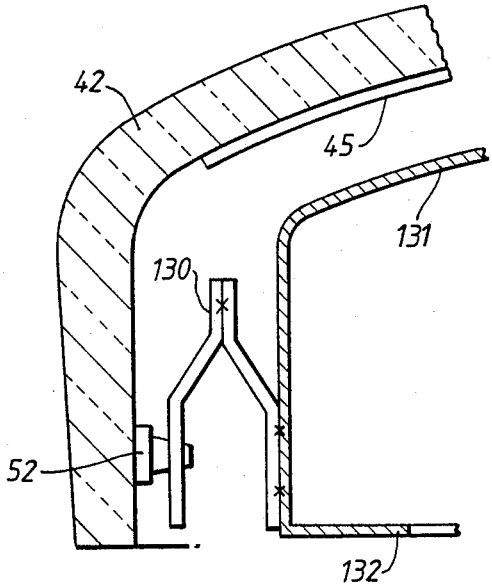
FIG. 15 is a sectional view illustrating still another embodiment according to the present invention, FIGS. 16*a*, 16*b* and 16*c* respectively illustrate still other modifications according to the present invention.
Figure 16A:
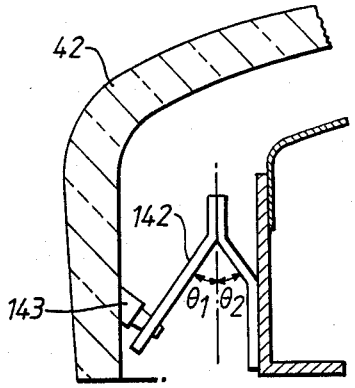
Figure 16B:
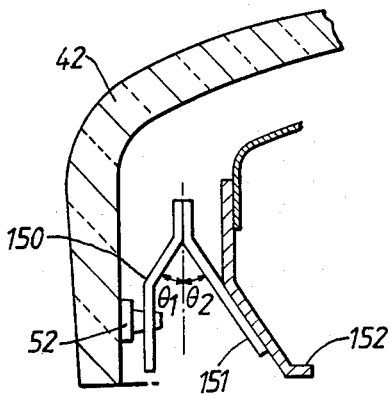
Figure 16C:
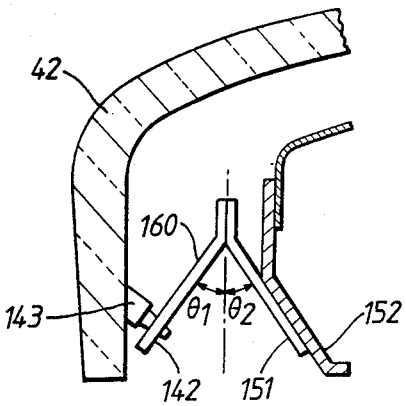

Moreover, as shown in FIG. 15, even when a shadow mask portion 131 and a mask frame portion 132 are formed integrally, the same advantages as those in the abovementioned embodiments can be obtained by a support member 130. Further, even when the following embodiments shown in FIGS. 16*a*, 16*b* and 16*c* are carried out, the same advantages as those in the abovementioned embodiments can be obtained. Namely, as shown in FIG. 16*a*, the cross-section of a first arm portion 142 that engages wi&h a stud pin 143 is substantially flat. In FIG. 16*b*, the cross-section of a second arm portion 151 of a support member 150 rigidly secured to a mask frame 152 is substantially flat. In FIG. 16*c* a support member 160 is a combination of the first and second arm portions 142 and 151 shown in FIGS. 16*a* and 16*b*.

Figure 3:
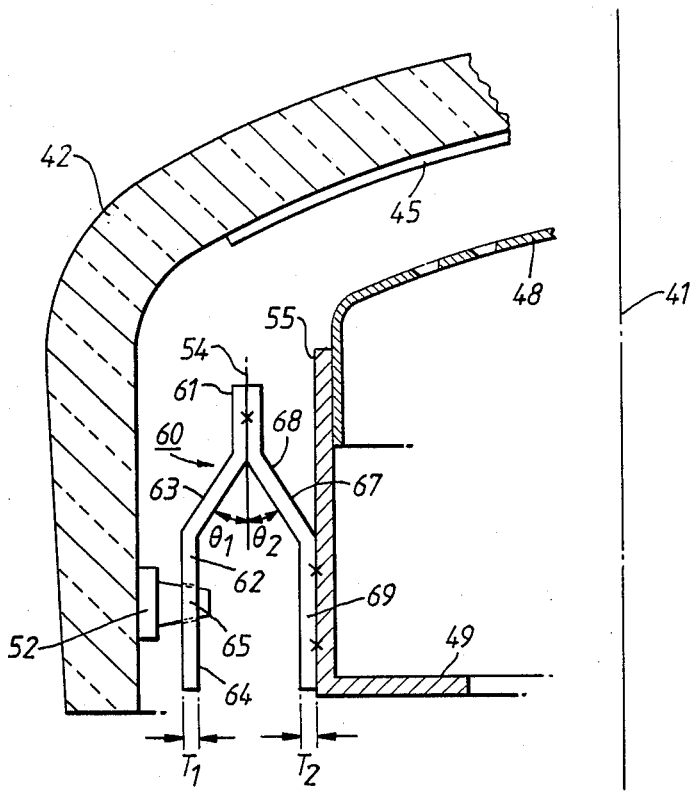
FIG. 3 is a sectional view illustrating an enlarged essential portion shown in FIG. 1.

Furthermore, in FIG. 3, when the thickness $T_2$ of the second arm portion 67 is designed to be greater than the thickness $T_1$ of the first arm portion 62, the shadow mask structure can be harder to fall from the stud pin 52, and can be more resistant against external impacts.

As described above, in a color picture tube with a shadow mask having a thermal expansion coefficient smaller than that of a mask frame supported at four corners inside the panel portion, long-term color purity drift which has hitherto occurred can be significantly reduced. In addition, attach/detach operations of the shadow mask structure become superior to those in the prior art, and this can significantly improve the productivity in the mass production of color picture tubes.

Obviously, numerous additional modifications and variations of the present invention are possible in light of the above teachings. It is therefore to be understood that within the scope of the appended claims the invention may be practiced otherwise than as specifically described herein.

What is claimed is:

1. A color picture tube comprising:

an evacuated envelope with a tube axis, comprising a rectangular shaped panel portion with stud pins, a funnel portion connected to the panel portion and a neck portion projected from the funnel portion;

a phosphor screen formed on the inner surface of the panel portion, the center of the phosphor screen perpendicularly passed through by the tube axis;

an electron gun for generating electron beams to excite said phosphor screen;

a shadow mask structure comprising a rectangular shaped mask position facing the phosphor screen with a large number of apertures, and a mask frame supporting the shadow mask at the periphery thereof; and a plurality of support members for suspending the shadow mask structure to the stud pins, each of support members also comprising:

a folded portion;

a first arm portion having a connection section extending from the folded portion at a first predetermined angle with respect to a parallel line in parallel with the tube axis so as to extend close to the panel portion and an attachment section connected to the connection section and engaged with the stud pin; and a second arm portion having an angled section extending from the folded portion at a second predetermined angle with respect to the parallel line so as to extend close to the mask frame and a fastening section fixed to the mask frame, the first and second arm portions connected with each other at the folded portion such that the attachment section and the fastening section face one another, whereby movement of said shadow mask structure towards said phosphor screen is minimized.

2. The color picture tube according to claim 1, wherein the mask frame includes a sidewall, and the angled section of each support member is separated from the sidewall of the mask frame.

3. The color picture tube according to claim 1, wherein the envelope includes a plurality of stud pins for attachment to the first arm portions, and the connection between the first arm portion and the angled section of each support member closer to the phosphor screen than the corresponding stud pin.

4. The color picture tube according to claim 1, wherein the first and second arm portion are integrally formed.

5. The color picture tube according to claim 1, wherein each the support member includes a single member bent substantially into a V-shape, one side of the V-shape being engaged with envelope, and the other side being secured rigidly to the mask frame.

6. The color picture tube according to claim 1, wherein the mask frame and the shadow mask are integrally formed.

7. The color picture tube according to claim 1, wherein the second arm portion thicker than the first arm portion.

8. The color picture tube according to claim 1, wherein the shadow mask has a thermal expansion coefficient smaller than that of the mask frame.

9. The color picture tube according to claim 1, wherein the envelope includes a tube axis, the first arm portion includes an attachment section, and a connection section angled with respect to the attachment section, and the angle formed between the connection section and a line parallel to the tube axis through the connection between the angled section and the first arm portion being greater than the angle formed between the angled section and the parallel line.

10. A color picture tube comprising:

an evacuated envelope having a rectangular panel;

a phosphor screen formed on the inner surface of the rectangular panel portion, an electron gun for discharging electron beams to excite the phosphor screen to emit light, a substantially rectangular shadow mask positioned closely facing the phosphor screen and having a large number of apertures therein, and a substantially rectangular mask frame for holding the shadow mask at the periphery thereof and having a thermal expansion coefficient greater than that of the shadow mask;

four support members for engaging the frame; four stud pins implanted at the corners on the inner surfaces of sidewalls of the panel portion each of the support members having a folded portion, a first arm portion to be engaged with the stud pin and a second arm portion secured to the mask frame, the first and second arm portions being connected to each other by the folded portion;

the support member satisfying following relationship:

$$\frac{\tan\theta_1}{K_1} < \frac{\tan\theta_2}{K_2}$$

where $K_1$ (Kg f/mm) is the spring constant of the first arm portion, $K_2$ (Kg f/mm) is the spring constant of the second arm portion, and $\theta_1$ is an angle formed between a line that passes through the folded portion of the support member parallel to the tube axis and the plane of the connection section of the first arm portion, and $\theta_2$ is an angle formed between the line being in parallel with the tube axis and the plane of the angled section of the second arm portion.

11. The color picture tube according to claim 10, wherein the spring constant of the first arm portion is larger than the spring constant of the second arm portion.

12. The color picture tube according to claim 10, wherein the thickness of the first arm portion is thicker than the thickness of the second arm portion.

13. The color picture tube according to claim 10, wherein the length of the connection section of the first arm portion is shorter than the length of the angled section of the second arm portion.

* * * * *